US007454918B2

(12) United States Patent
Davern et al.

(10) Patent No.: US 7,454,918 B2
(45) Date of Patent: Nov. 25, 2008

(54) REFRIGERATION AND DEFROST CONTROL SYSTEM

(75) Inventors: Thomas J. Davern, St. Charles, IL (US); Jack Devine, Carol Stream, IL (US); William B. Bennett, Allegan, MI (US)

(73) Assignee: Robertshaw Controls Company, Richmond, VA (US)

( * ) Notice: Subject to any disclaimer, the term of this patent is extended or adjusted under 35 U.S.C. 154(b) by 451 days.

(21) Appl. No.: 11/093,912

(22) Filed: Mar. 30, 2005

(65) Prior Publication Data

US 2006/0218946 A1 Oct. 5, 2006

(51) Int. Cl.
*F25D 21/06* (2006.01)

(52) U.S. Cl. ..... 62/155; 62/150; 62/151; 62/153; 62/154; 62/80; 62/275; 62/234

(58) Field of Classification Search ..... 62/150–151, 62/153–155, 158, 80, 277, 234, 275
See application file for complete search history.

(56) References Cited

U.S. PATENT DOCUMENTS

| | | | | |
|---|---|---|---|---|
| 2,736,173 | A * | 2/1956 | Duncan | 62/153 |
| 2,940,277 | A | 6/1960 | Pas et al. | |
| 3,914,951 | A | 10/1975 | Heidorn | |
| 3,924,416 | A * | 12/1975 | Durdin | 62/80 |
| 4,392,357 | A * | 7/1983 | Kinsey et al. | 62/153 |
| 2003/0182951 | A1 * | 10/2003 | Rafalovich et al. | 62/154 |

* cited by examiner

*Primary Examiner*—Cheryl J. Tyler
*Assistant Examiner*—Emily Iris Nalven
(74) *Attorney, Agent, or Firm*—Reinhart Boerner Van Deuren P.C.

(57) ABSTRACT

A system and method for refrigeration timer control having an energy efficient defrost cycle are provided. The system and method provide a delay time after the refrigeration cycle and prior to the defrost cycle. During this delay period the evaporator fan may run. The fan circulation and the heat from the fan coil provide a pre-warm cycle to the evaporator prior to the defrost cycle. To further enhance energy efficiency, the system and method may also provide a pre-refrigeration cycle after the defrost cycle. During this pre-refrigeration cycle only the compressor is energized. This prevents warm moist air from being circulated until the evaporator coils are cooled.

14 Claims, 6 Drawing Sheets

REFRIGERATION AND DEFROST CONTROL SYSTEM

FIELD OF THE INVENTION

This invention pertains to refrigeration control systems, and more particularly to cam operated refrigeration control systems that include refrigeration and defrost control cycles.

BACKGROUND OF THE INVENTION

Defrost timers are used to control defrost heaters in freezers and refrigerator/freezers. While their application is mainly for commercial applications, many higher-end consumer refrigeration appliances also now include such defrost timers. The defrost heater prevents excessive ice build up on the evaporator coil to prevent cooling inefficiency in the refrigeration system.

In operation, the defrost timer initiates a defrost cycle after a preset compressor run time. Such compressor run times are selected based on experience with the icing phenomenon for a particular model, installation, etc. That is, it is know that a certain degree of icing on the evaporator coils is likely to have formed once the compressor has been run for a particular length of time. After such icing has likely occurred, the defrost timer initiates a defrost cycle to clear the ice from the coils to maintain the cooling efficiency of the system. The defrost timer also controls the length of the defrost cycle. The length of the defrost cycle is also preset based, once again, on typical icing conditions. That is, the defrost cycle is run for a period sufficient to remove the ice from the coils that has developed during the compressor run cycle.

As is well known, during a typical compressor operation the evaporator fan is running to circulate air over the chilled evaporator coils to cool the chamber. Unfortunately, current defrost timers operate to initiate a defrost cycle immediately after the compressor run cycle has terminated. This results in additional energy usage by the defrost heater because it has to overcome the cooling effects of the just-terminated cooling cycle. That is, immediately after the cooling cycle has ended, and for some period thereafter, the evaporator coils are still very cold from the evaporation of the coolant therein. At least until the evaporation of the coolant in the evaporator has ended, the application of energy to the defrost heater will have little effect to defrost the coils. As such, the defrost heater is simply wasting energy without effect.

There exists, therefore, a need in the art for a new and improved defrost timer that provides adequate defrosting of the evaporator coils of a refrigeration system without consuming excess energy without effect.

BRIEF SUMMARY OF THE INVENTION

In view of the above, it is an objective of the present invention to provide a new and improved defrost timer. More particularly, it is an objective of the present invention to provide a new and improved defrost timer that operates to reduce the energy consumption of the defrost cycle while still providing the needed defrosting of the evaporator coils. Still more particularly, it is an objective of the present invention to provide a new and improved refrigeration control system that coordinates the operation of the components of the refrigeration system and the defrost system to provide energy efficient cooling and defrosting operation.

One embodiment of the invention provides a refrigeration control system that integrates control of the operation of a compressor, evaporator fan, and a defrost heater for a freezer/refrigerator. The refrigerant system includes a motor-operated compressor, an evaporator coil for cooling the freezer, an evaporator fan that circulates air over the evaporator coil and into the freezer compartment, and a defrost heater. The defrost heater is periodically operated to remove frost build-up from the evaporator coil.

In one embodiment, the refrigeration control system includes a motor-driven cam operated switch arrangement that includes a compressor blade, an evaporator fan blade, a defrost heater blade, and a power source blade. In this embodiment the compressor blade and evaporator fan blade contact the power source blade in a refrigeration cycle. Once the refrigeration cycle has ended, the compressor blade disconnects from the power blade such that only the evaporator fan contracts the power source blade. In this way the continued circulation of air and heat from the fan coil will begin the pre-defrosting of the coils. After the pre-defrost cycle, the evaporator fan blade disconnects from the power source blade and the defrost heater blade connects with the power source blade. This allows the defrost heater to defrost the evaporator coils in a defrost cycle mode.

Another embodiment of the invention provides an energy efficient refrigeration control method for controlling the operation of a compressor, evaporator fan, and a defrost heater in a freezer having a refrigerant system that includes a motor-operated compressor, an evaporator coil, an evaporator fan, and a defrost heater for periodically removing frost build-up from the evaporator coil. The refrigeration control method includes connecting the compressor and the evaporator fan to a power source for operation during a normal operation cycle, disconnecting the compressor from the power source so that only the evaporator fan receives power during a pre-defrost cycle, disconnecting the evaporator fan from the power source, and connecting the defrost heater to the power source for operation during a defrost cycle.

Other features and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

To overcome the above described and other problems existing in the art, the refrigeration timer control system coordinates operation of the defrost heater with the refrigeration cycle. Specifically, in the system of the present invention the energization of the defrost heater is delayed for a period of time after the compressor has been de-energized. In this way, the evaporator coils are allowed to warm, or at least are no longer providing cooling, after the refrigeration cycle has ended and the refrigerant is no longer evaporating through the coils. By delaying the energization of the defrost heater, energy is not wasted while the evaporator coils are still providing cooling due to the evaporation of refrigerant after the compressor has stopped and due to the thermal inertia of the coils themselves.

Other embodiments of the refrigeration control system of the present invention add a new cycle that allows the evaporator fan to continue to run for a period of time after the compressor has been de-energized and before the defrost heater is energized. This serves to provide a pre-warm cycle during which the relatively warmer air within the refrigerator or freezer cavity is circulated over the evaporator coils. Further, the heat from the fan coil itself provides additional warming to the evaporator prior to the defrost cycle being started while continuing to cool the air into the compartment. By delaying the energization of the defrost heater and by providing the pre-warming cycle, a net energy savings over prior systems discussed above is realized. This savings is brought about because the high wattage defrost heater is not required to run as long to defrost the evaporator coil as conventional defrost systems.

Figure 1:
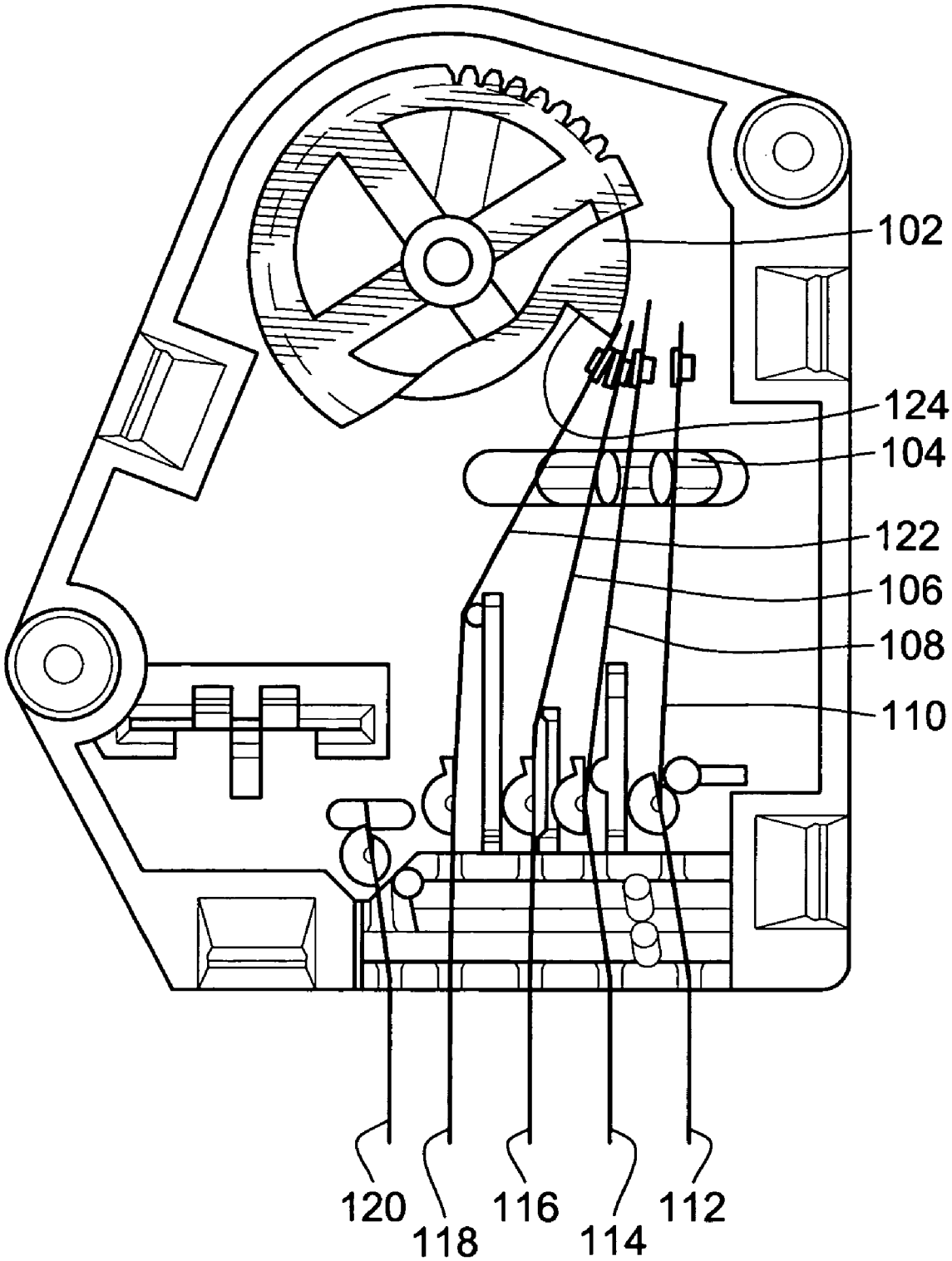
FIG. 1 illustrates an embodiment of a refrigeration timer control system constructed in accordance with the teachings of the present invention in normal operation cycle.

Turning now to the drawings, there is illustrated in simplified form in FIG. 1 an embodiment of a refrigeration timer control system constructed in accordance with the teachings of the present invention. However, as will be understood by those skilled in the art, the embodiments illustrated and discussed below are provided by way of example and not by way of limitation. As such, applicants reserve the full scope of protection for their invention as defined by the appended claims.

As may be seen from FIG. 1, such an embodiment of the refrigeration timer control system includes a motor driven cam 102 having an outer periphery that defines at least one program fall 124. As will be discussed below, this program fall 124 operates to control the switching of the various control and power blades 106, 108, 110, and 122 that follow the periphery of the cam 102. These control and power blades 106, 108, 110, and 122 provide selected energization of contacts 112-118. Power to the assembly is provided by power contact 120.

While not illustrated to simplify the drawings and the following discussion, those skilled in the art will recognize that a conventional motor may be provided in the assembly of FIG. 1 to drive the program cam 102, directly or, more typically, through gearing. As configured in FIG. 1, the motor drives the cam 102 in a counter-clockwise direction. The various refrigeration and defrost cycles are controlled by the positioning and contacting of the contacts of blades 106, 108, 110, and 122 as will be described more fully below. Proper switching operation is also aided by the movable spacer 104 as will also be described more fully below.

During the normal refrigeration cycle, the compressor control blade 122 and the evaporator fan control blade 106 are in contact with the electrical common blade 108 to complete the electrical circuit. This energizes the compressor and evaporator fan (not shown) via contacts 118 and 116, respectively, to provide cooling to the refrigerator/freezer. The positioning of the evaporator fan control blade 106 in relation to the spacer 104 ensures that the defrost heater control blade 110 does not come into contact with the common blade 108 during this refrigeration cycle.

Figure 2:
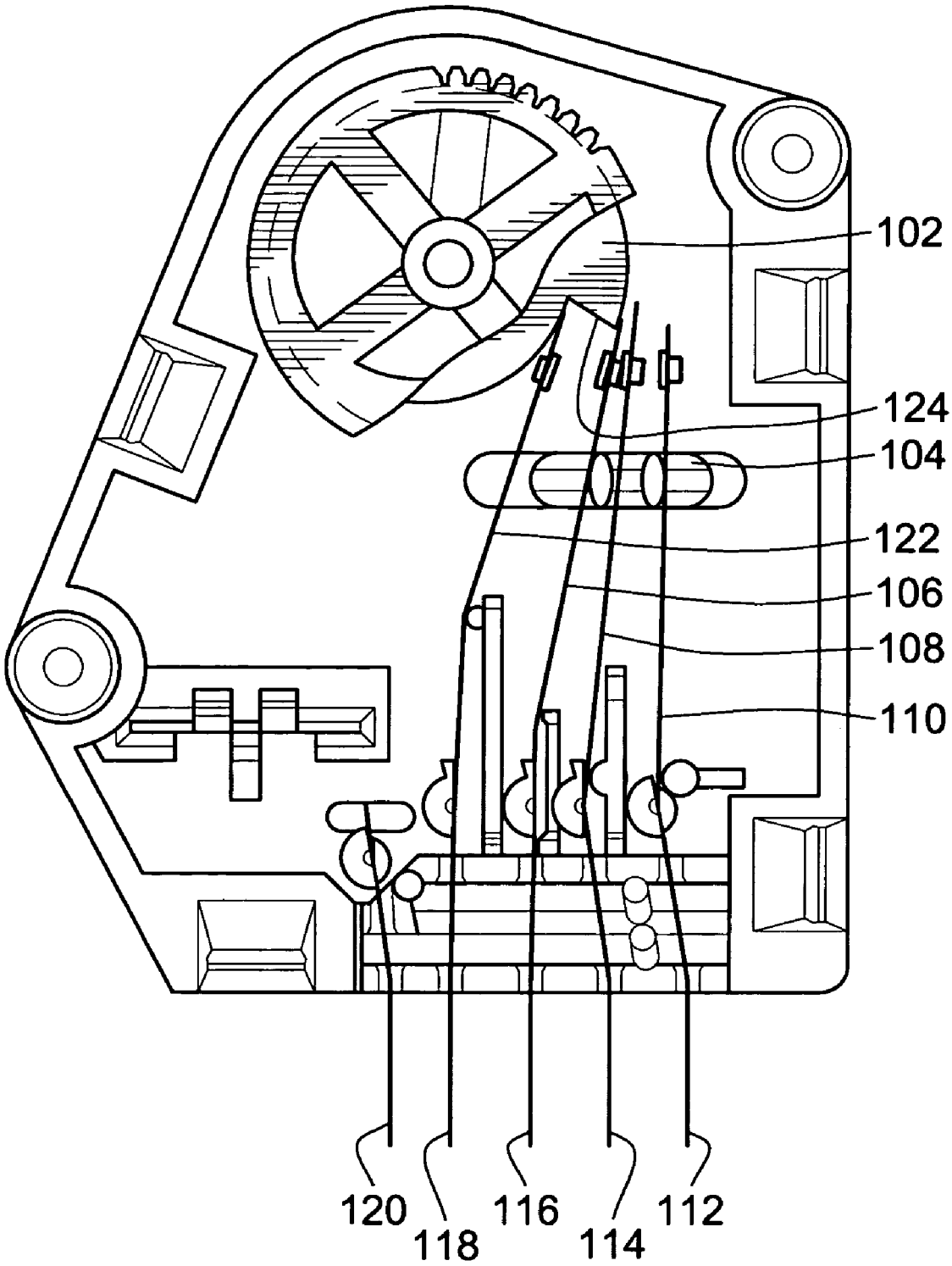
FIG. 2 illustrates the refrigeration timer control system of FIG. 1 in an pre-warm cycle following the normal operation cycle illustrated in FIG. 1.

As the cam 102 continues to rotate counter-clockwise from the position illustrated in FIG. 1, the compressor control blade 122 encounters the cam control fall 124. This condition, which ends the refrigeration cycle and begins the pre-warm cycle, is illustrated in FIG. 2. During this pre-warm cycle, the compressor is de-energized because it is no longer in contact with the common blade 108, thus breaking the electrical circuit. However, because the length of the evaporator fan control blade 106 allows it to stay on the cam surface before the fall 124 after the compressor control blade 122 has dropped, the evaporator control blade remains in contact with the common blade 108.

In this configuration, the compressor is de-energized but the evaporator fan is still energized. This allows the fan to continue to circulate air from the refrigerator/freezer compartment across the evaporator coils. This, along with the heat from the fan coil, pre-warms the evaporator coils to begin the defrost process. Because the evaporator fan control blade 106 is still held in this actuated position, it continues to act through spacer 104 to hold the defrost heater control blade 110 away from the common blade 108. As such, in this state only the evaporator fan is energized.

Figure 3:
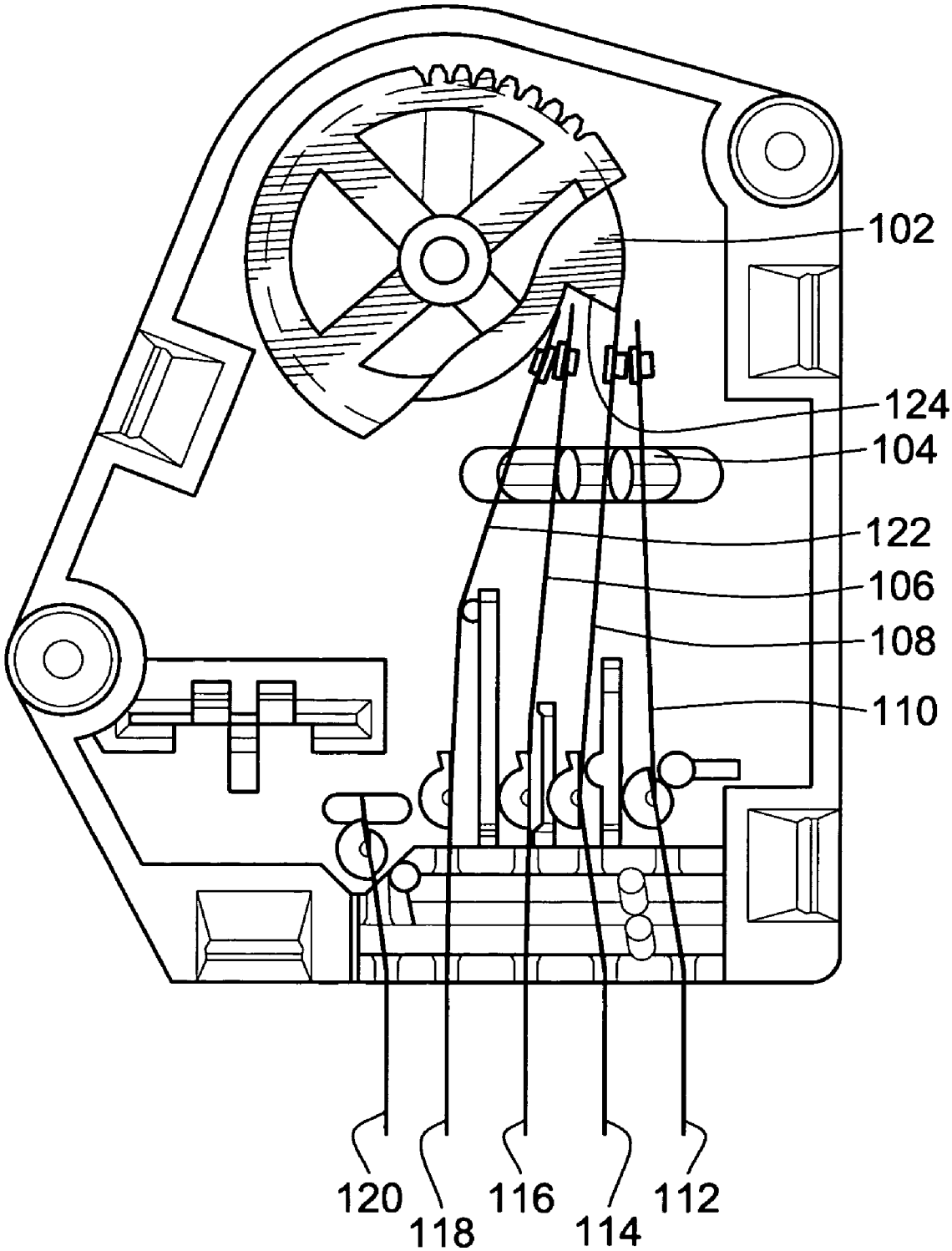
FIG. 3 illustrates the refrigeration timer control system of FIG. 1 in a defrost cycle following the pre-warm cycle illustrated in FIG. 2.

As the cam 102 continues to rotate in a counter-clockwise direction, the evaporator fan control blade 106 will encounter the cam fall 124, initiating the defrost cycle. When this occurs, as illustrated in FIG. 3, the evaporator fan will be de-energized because its control blade 106 will no longer be in contact with the common blade 108. The length of the common blade 108 allows it to maintain contact with the cam surface before the fall 124. When the evaporator fan control blade 106 falls, the holding force on spacer 104 is released allowing spacer 104 to slide to the position shown. With the spacer 104 in this position, the defrost heater control blade 110 is permitted to contact the common blade 108, thus supplying power to the defrost heater and beginning the defrost cycle.

Figure 4:
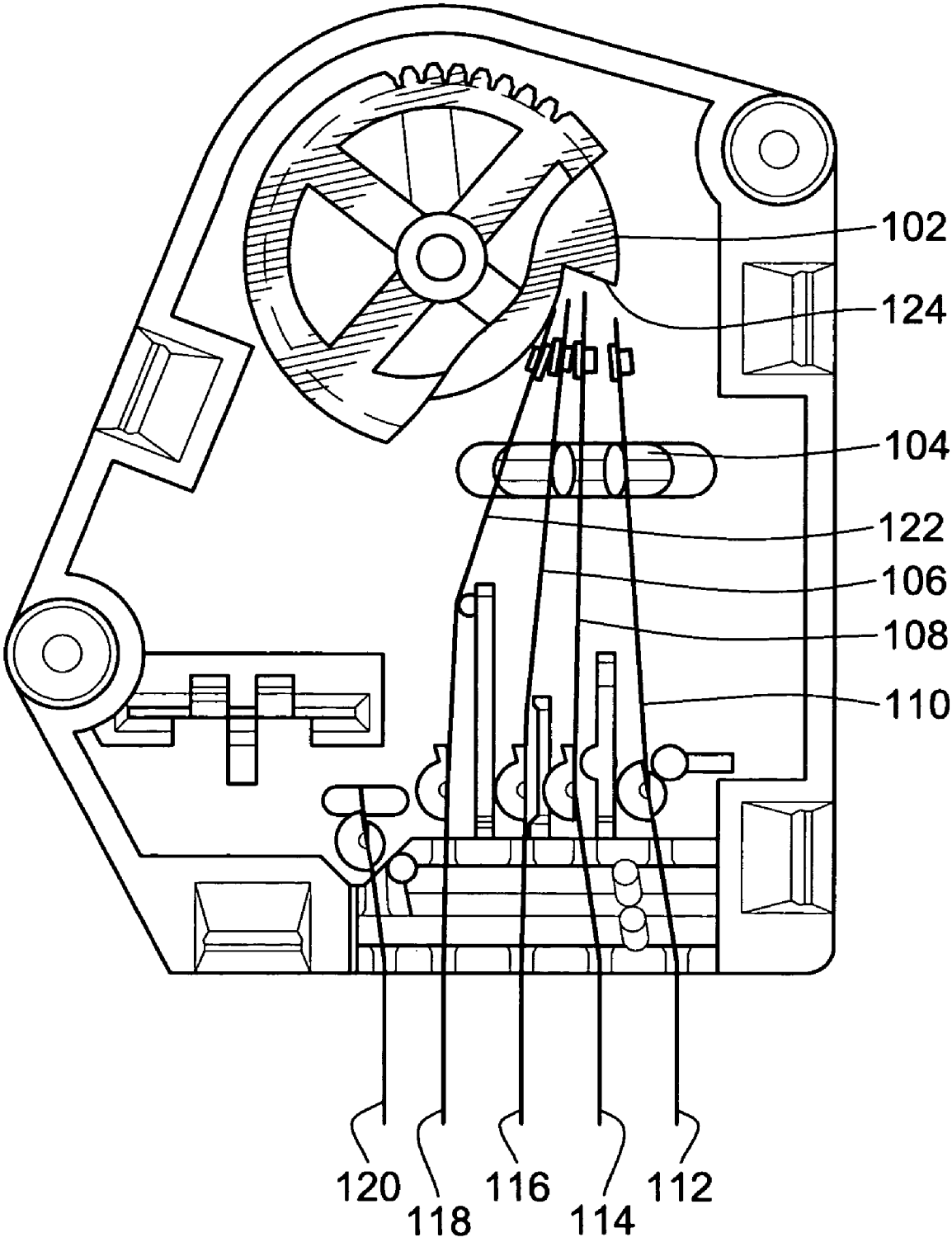
FIG. 4 illustrates a refrigeration timer control system of FIG. 1 in the normal operation cycle following the defrost cycle illustrated in FIG. 3.

FIG. 4 shows the defrost timer control system state right after defrost cycle has ended. As the cam 102 continues to rotate, the common blade 108 falls over cam fall 124, thus losing contact with heater blade 110. This loss of contact causes the defrost heater to shut off. However, the common blade 108 falls into contact with both the compressor control blade 122 and the evaporator fan control blade 106. In this state, the compressor and evaporator fan are running in the normal refrigeration cycle. The spacer 104 again holds the defrost heater control blade 110 away from the common blade 108 as illustrated.

Figure 5:
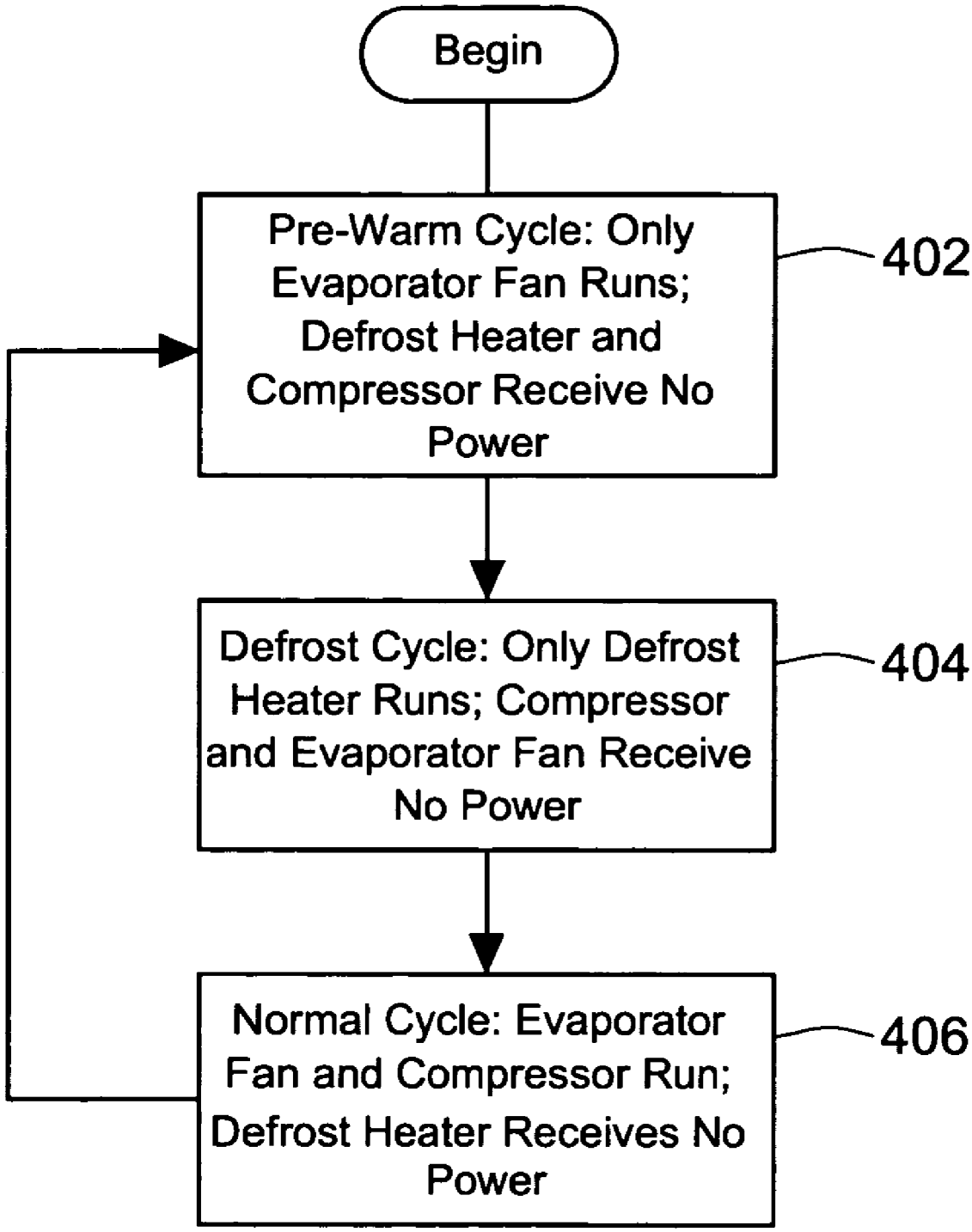
FIG. 5 is a flow diagram illustrating a method for operation of a refrigeration timer control system in accordance with one embodiment of the invention.

As may now be apparent to those skilled in the art, the present invention provides a method of controlling and coordinating the refrigeration and defrost cycles to increase energy efficiency. Indeed, some embodiments of the present invention introduce a pre-warm cycle between the refrigeration and defrost cycles to further enhance the energy efficiency of this method. FIG. 5 illustrates the states of the system for the method of operation of the refrigeration timer control system in accordance with one embodiment of the invention. At state 402, the refrigeration timer control system is in an evaporator fan only state, providing the pre-warm cycle discussed above. In this state 402, only an evaporator fan receives power. At state 404, the refrigeration timer control system is in a defrost cycle. In this state 402, only the defrost heater receives power. At state 406, the refrigeration timer control system is in a normal refrigeration operational state. In this state 406, the compressor and the evaporator fan receive power from the power source.

With the preceding embodiment, the compressor and the evaporator fan are bother energized simultaneously after the defrost cycle. The evaporator fan will begin circulating air immediately upon energization. However, the evaporator cannot provide cooling immediately because the evaporator coils will still be warm from the defrost cycle. As such, there is a period of time after the defrost cycle when warm moist air is circulated in the chamber, which will somewhat warm the chamber at the beginning of the refrigeration cycle. Because of this initial warming caused by the circulation of this warm post-defrost air, additional energy will need to be expended to cool the chamber.

To preclude such an occurrence, an embodiment of the invention provides an alternate blade configuration that utilizes an extra switch state to provide a compressor-only state immediately following the defrost cycle. In other words, the evaporator fan is not energized for a period after the end of the defrost cycle to preclude circulation of air across the warm evaporator coils. This state provides additional energy savings by delaying the circulation of air in the chamber until the evaporator coils have cooled.

Figure 6:
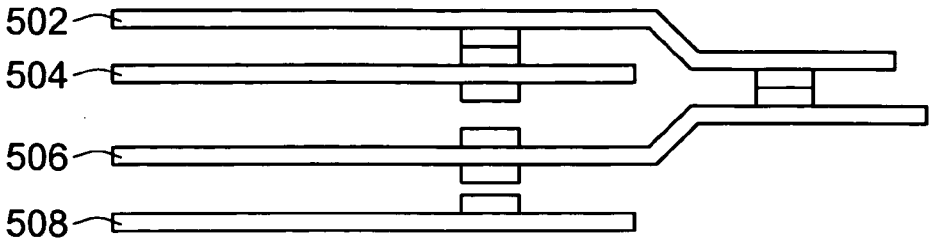
FIG. 6 illustrates a switch state of an alternate embodiment of a refrigeration timer control system in a normal operation cycle.
Figure 7:
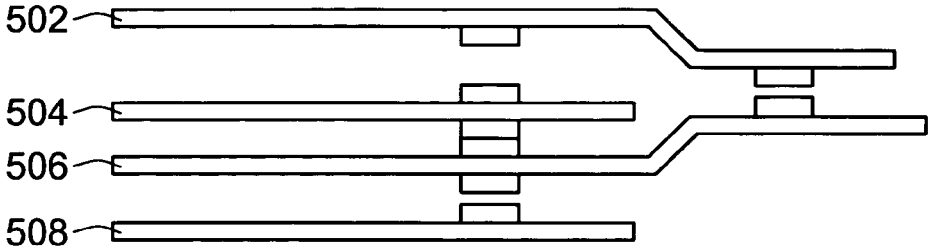
FIG. 7 illustrates the switch state of the refrigeration timer control system of FIG. 6 in a pre-warm cycle following the normal operation cycle illustrated in FIG. 6.
Figure 8:
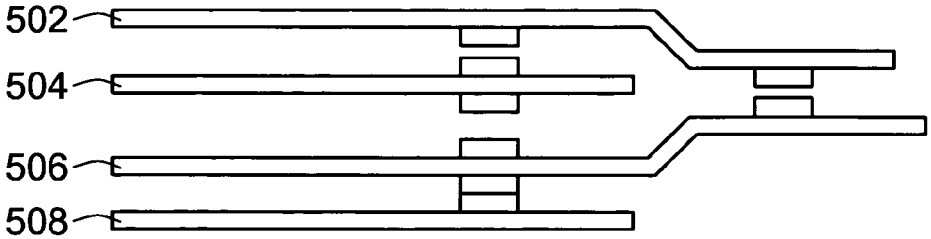
FIG. 8 illustrates the switch state of the refrigeration timer control system of FIG. 6 in a defrost cycle following the pre-warm cycle illustrated in FIG. 7.
Figure 9:
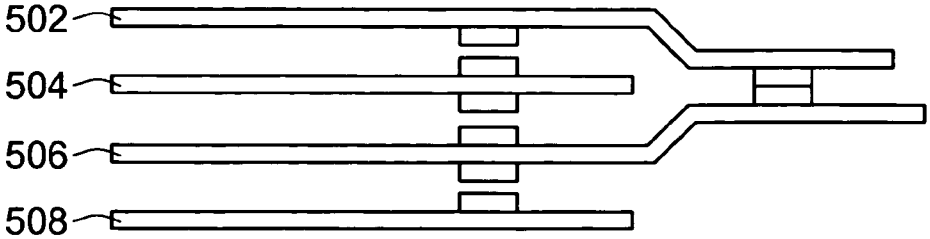
FIG. 9 illustrates the switch state of the refrigeration timer control system of FIG. 6 in post-defrost cycle following the defrost cycle illustrated in FIG. 8.

The blade configuration of a refrigeration timer control system in accordance with this embodiment of the invention is shown in FIGS. 6-9. As will be recognized by those skilled in the art, a multi-level cam is necessary to control the additional switch state. FIG. 6 shows the state where the compressor control blade 502 and evaporator fan control blade 504 are in contact with the common blade 506. This switch state corresponds to the "normal" refrigeration cycle operation when cooling is required. FIG. 7 shows the evaporator fan control blade 504 only in contact with the common blade 506. This switch state corresponds to the pre-defrost, evaporator fan-only state that provides a pre-warm for the defrost cycle as described above. FIG. 8 shows the defrost heater control blade 508 in contact with the common blade 506, which corresponds to the defrost cycle. Finally, FIG. 9 shows the compressor blade 502 only in contact with the common blade 506. This state is the post-defrost state which allows for the evaporator coil to cool prior to air circulation by the evaporator fan.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. In a freezer having a refrigeration system including a compressor, an evaporator coil, an evaporator fan to circulate air over the evaporator coil and into a compartment of the freezer, a defrost heater for periodically removing frost build-up from the evaporator coil, and a timer control system controlling the operation of the compressor, evaporator fan, and defrost heater, the timer control system comprising:

a switch arrangement including a compressor control blade, an evaporator fan control blade, a defrost heater control blade, and a common blade;

a rotatable cam having a profiled surface in operable communication with the switch arrangement controlling a relative positioning of the blades of the switch arrangement such that the compressor control blade and evaporator fan control blade contact the common blade in a first cycle, the defrost heater control blade connects with the common blade in a second cycle, and wherein the cam provides a third cycle between the first cycle and the second cycle delaying the defrost heater control blade from contacting the common blade for a period of time after the first cycle.

2. The timer control system of claim 1, wherein the evaporator fan control blade contacts the common blade during the third cycle.

3. The timer control system of claim 1, wherein the profiled surface of the cam includes at least one program fall, and wherein compressor control blade encounters the program fall to initiate the third cycle.

4. The timer control system of claim 3, wherein common blade encounters the program fall to initiate the first cycle.

5. The timer control system of claim 2, wherein the profiled surface of the cam includes at least one program fall, and wherein the evaporator fan control blade encounters the program fall to initiate the second cycle.

6. The timer control system of claim 5, further comprising a spacer for forcing the defrost heater control blade away from the common blade during the first and third cycles.

7. The timer control system of claim 6, the spacer is actuated by the evaporator fan control blade.

8. The timer control system of claim 1, further comprising a fourth cycle between the second and first cycles wherein the compressor control blade contacts the common blade and the evaporator fan control blade does not contact the common blade.

9. A refrigeration control timer, comprising:

a motor-driven cam having at least one program control track;

a compressor control blade;

an evaporator fan control blade;

an electrical circuit blade; and a defrost heater control blade; and wherein the at least one program control track operates in relation to the compressor control blade, the evaporator fan control blade, the electrical circuit blade, and the defrost heater control blade connecting the compressor control blade and the evaporator fan control blade to the electrical circuit blade during a refrigeration cycle, connecting the evaporator fan control blade to the electrical circuit blade during a pre-warm cycle, connecting the defrost heater control blade to the electrical circuit blade during a defrost cycle.

10. The refrigeration control timer of claim 9, further comprising a spacer in operative communication with the evaporator fan control blade and the defrost heater control blade to prevent the defrost heater control blade from contacting the electrical circuit blade during the refrigeration cycle and the pre-warm cycle.

11. The refrigeration control timer of claim 9, wherein the program control track includes at least one fall operative to disconnect the compressor control blade from the electrical circuit blade during the pre-warm cycle and the defrost cycle, to disconnect the evaporator fan control blade from the electrical circuit blade during the defrost cycle, and to connect the electrical circuit blade to the compressor control blade and the evaporator fan control blade during the refrigeration cycle.

12. The refrigeration control timer of claim 9, wherein the at least one program control track is operable in relation to the compressor control blade, the evaporator fan control blade, the electrical circuit blade, and the defrost heater control blade to connect the compressor control blade to the electrical circuit blade during a pre- refrigeration cycle.

13. The refrigeration control timer of claim 12, wherein the at least one program control track controls a sequence of cycles such that the refrigeration cycle is followed by the pre-warm cycle, which is followed by the defrost cycle, which is followed by the pre-refrigeration cycle, which is followed by the refrigeration cycle.

14. The refrigeration control timer of claim 9, wherein the at least one program control track controls a sequence of cycles such that the refrigeration cycle is followed by the pre-warm cycle, which is followed by the defrost cycle, which is followed by the refrigeration cycle.

* * * * *